United States Patent [19]

Walker et al.

[11] Patent Number: 4,484,678

[45] Date of Patent: Nov. 27, 1984

[54] AMMUNITION RACK FOR VEHICLES

[75] Inventors: Evan H. Walker, Aberdeen; Gould Gibbons, Jr., Finksburg; Gilbert A. Bowers, Aberdeen, all of Md.

[73] Assignee: The United States of America as represented by the Secretary of the Army, Washington, D.C.

[21] Appl. No.: 482,360

[22] Filed: Apr. 5, 1983

[51] Int. Cl.[3] ..... F42B 37/00

[52] U.S. Cl. ..... 206/3; 224/249; 224/324; 224/325

[58] Field of Search ..... 206/3, 305; 224/323, 224/324, 325, 309, 42.46 R, 918, 249, 234; 211/60 R, 60 G, 64, 69, 70.2; 294/159; 248/399

[56] References Cited

U.S. PATENT DOCUMENTS

| | | | |
|---|---|---|---|
| 2,995,280 | 8/1961 | Thierry | 224/249 |
| 3,153,500 | 10/1964 | Pachmayr et al. | 224/249 |
| 3,164,185 | 1/1965 | Ingoldt | 294/159 |
| 3,172,681 | 3/1965 | Moses | 211/70.2 |
| 3,179,255 | 4/1965 | Decaccia | 211/69 |
| 3,273,846 | 9/1966 | De Mare | 211/69.1 |
| 3,337,058 | 8/1967 | Sandrick | 211/69 |
| 3,482,895 | 12/1969 | Becklin | 206/305 |
| 3,702,671 | 11/1972 | Cirillo | 224/249 |
| 4,057,214 | 11/1977 | Harder, Jr. | 248/399 |

*Primary Examiner*—Joseph Man-Fu Moy
*Assistant Examiner*—David T. Fidei
*Attorney, Agent, or Firm*—Anthony T. Lane; Robert P. Gibson; Edward F. Costigan

[57] ABSTRACT

An ammunition rack in a vehicle ammunition compartment helps protect the rounds from injury due to road shocks and propagation of an explosion, i.e., fratricide. The rack comprises a warhead block-mount fixture and parallel thereto, and spaced therefrom, a base block-mount fixture; both fixtures being of a resilient and flexible polymeric material and both having a set of holes therethrough; the holes in the two fixtures being aligned. Metal tubular sleeves are held within each pair of aligned fixture holes, the sleeves spanning the space between the fixtures. The ammunition rounds are removably inserted in the sleeves and held therein preferably by latch mechanisms.

5 Claims, 6 Drawing Figures

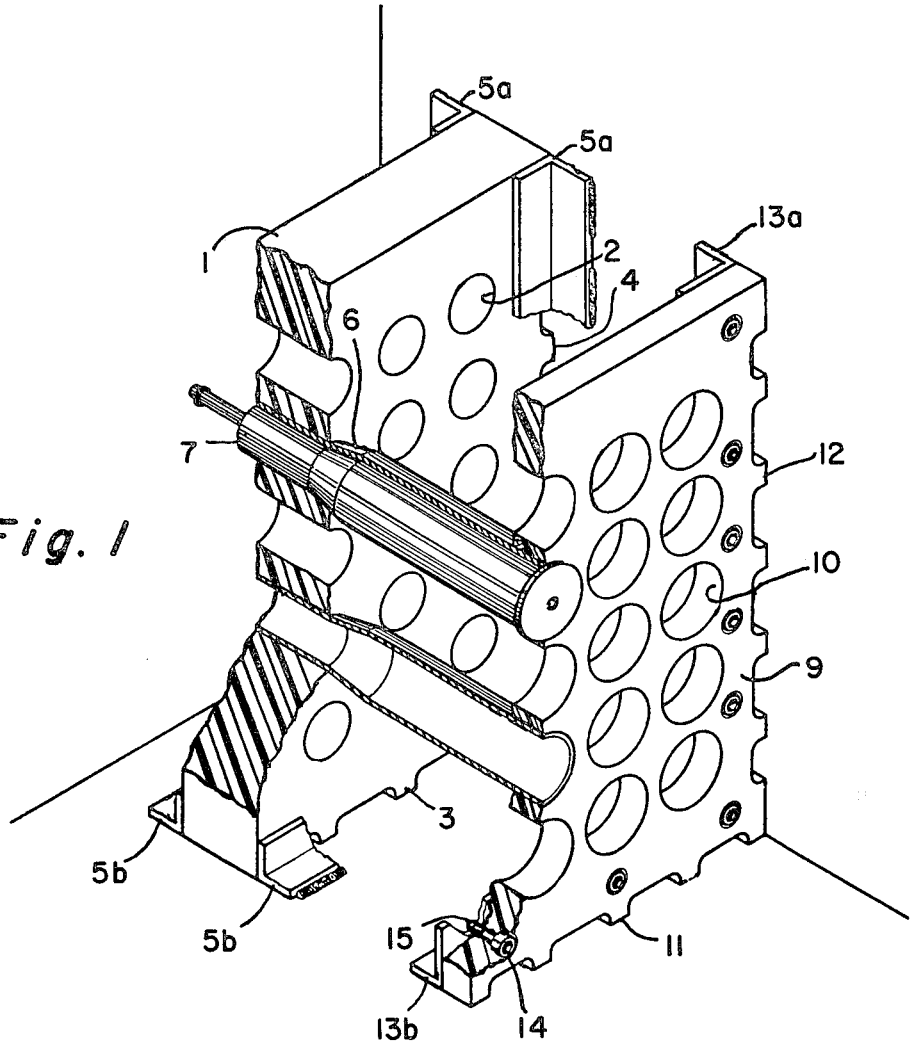
Fig. 1
Fig. 2
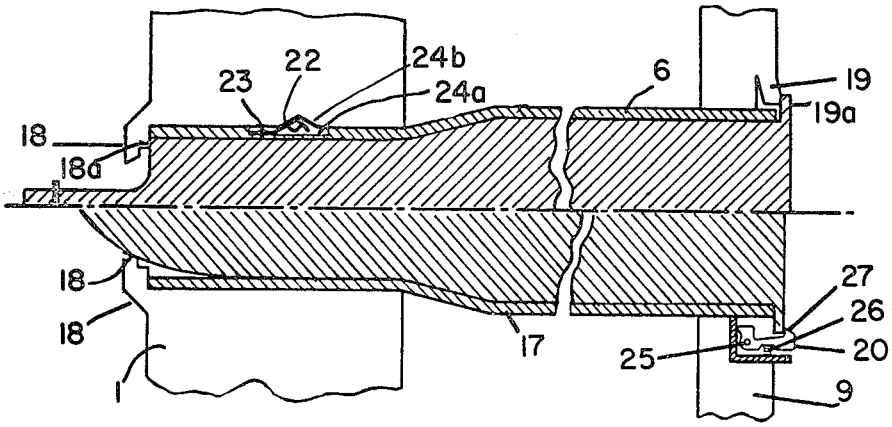

AMMUNITION RACK FOR VEHICLES

BACKGROUND OF THE INVENTION

At the present time tanks, and other types of fighting vehicles, may carry a cannon, as their main gun, and a supply of ammunition for the main gun. For example, a tank may have a 105 mm or 120 mm cannon as its main gun. The tank, or other fighting vehicle, may carry many rounds of ammunition in its ammunition compartment, for example, for a 120 mm gun it may be desired that the tank carry anywhere from 20 to 100 rounds (cannon shells) of ammunition.

It is important that the ammunition be protected against damage which may occur due to bumping against other ammunition rounds or against other portions of the vehicle while the vehicle is in motion. Frequently the vehicle will be traversing rough ground and the vibration and shocks to the ammunition (called "road shock") may be considerable. In addition, if the fighting vehicle is under attack, it may be hit by an enemy shell, causing one of the rounds of ammunition to explode. It is vital that such an explosion of one round of ammunition be contained so that it does not set off additional rounds; the setting off of the additional rounds being called "fratricide".

In the past, the ammunition for the main gun consisted of a warhead mounted at the end of a metal shell case. The case, since it was of a relatively strong material such as brass or other metals, was quite resistant to damages from road shock. However, new types of ammunition have been proposed which do not utilize a metal shell casing. Instead, a combustible case extends from the warhead to a metal base plate. The combustible case, compared to the metal casing, may be easily damaged by bumping against other rounds of ammunition or by bumping against other portions of the vehicle while the vehicle is in motion.

It has been proposed that one type of rack design which may be used for the shock mounting of the ammunition and to prevent the warhead fratricide is a rack of metal sleeves, with a sleeve encompassing each of the ammunition shells. The sleeves are shock-mounted using mechanical linkages whose ends are fixed to the supporting walls of the ammunition compartment. A polymeric material (a flexible and resilient plastic resin) may be used as part of the mechanical linkage so that the linkage is resilient and shock-absorbent. However, each of the sleeves may require a number of mechanical linkages so that an ammunition rack having a large number of individual sleeves requires a large number of mechanical linkages and attachment fixtures. Individual shock-absorbing antifratricide shields may be positioned between each of the warheads, in order to prevent the detonation of one of the warheads from propagating to its neighboring warhead. The plurality of shields and their mounting brackets add to the complexity of the ammunition rack.

The use of individual sleeves, with each sleeve being mounted by a number of mechanical linkages and with individual shields positioned between the sleeves, presents a variety of problems and drawbacks. In some cases the mechanical linkages prevent the proper placement of the anti-fratricide shields so that the shields could not be positioned for the optimum anti-detonation effect. The use of separate shields, sleeves and mechanical linkages provides a complex and costly system requiring a large number of spare parts. In addition, the large number of components presents difficulties in manufacturing and in servicing, since the rack must be installed in the ammunition compartment after the compartment has been fabricated. Consequently, the installer or service personnel must align the anti-fratricide shields and adjust the shock absorbing mechanical linkages by access to the ammunition compartment through its doorways, although the limited space in the compartment makes such installation and adjustment difficult.

OBJECTIVES AND FEATURES OF THE INVENTION

It is an objective of the present invention to provide an ammunition rack which is an integral element incorporating both means to prevent road shock from injuring the ammunition and shields to prevent detonation of a warhead from being propagated to its neighboring warheads.

It is a further objective of the present invention to provide such an ammunition rack in which the number of components is reduced compared to the previous designs, so as to simplify manufacture and simplify installation.

It is a still further objective of the present invention to provide such a rack which will provide thermal insulation of the warheads to prevent the warheads from exploding in the event of a heat rise in the ammunition compartment.

It is a still further objective of the present invention to provide such a rack which provides shock and vibration damping and warhead antifratricide and yet uses relatively fewer metal machined parts and whose principal elements are cast of polymeric material so as to simplify the manufacture and repair of the rack.

It is a further objective of the present invention to provide such a rack which will have structural integrity, i.e., not coming apart, during loading, storage and unloading of the ammunition.

It is a further objective of the present invention to provide ready and convenient access to the ammunition.

BRIEF DESCRIPTION OF THE DRAWINGS

Other objectives and features of the present invention will be apparent from the following detailed description of the invention and its accompanying drawings.

In the drawings:

FIG. 1 is a perspective partially cut-away view of the ammunition rack of the present invention showing two sleeves in place and with a round of ammunition in one of the sleeves;

FIG. 2 is a side cross-sectional view showing at its top portion one type of round of ammunition and at its bottom portion a different type of round of ammunition;

DETAILED DESCRIPTION OF THE INVENTION

Figure 3:
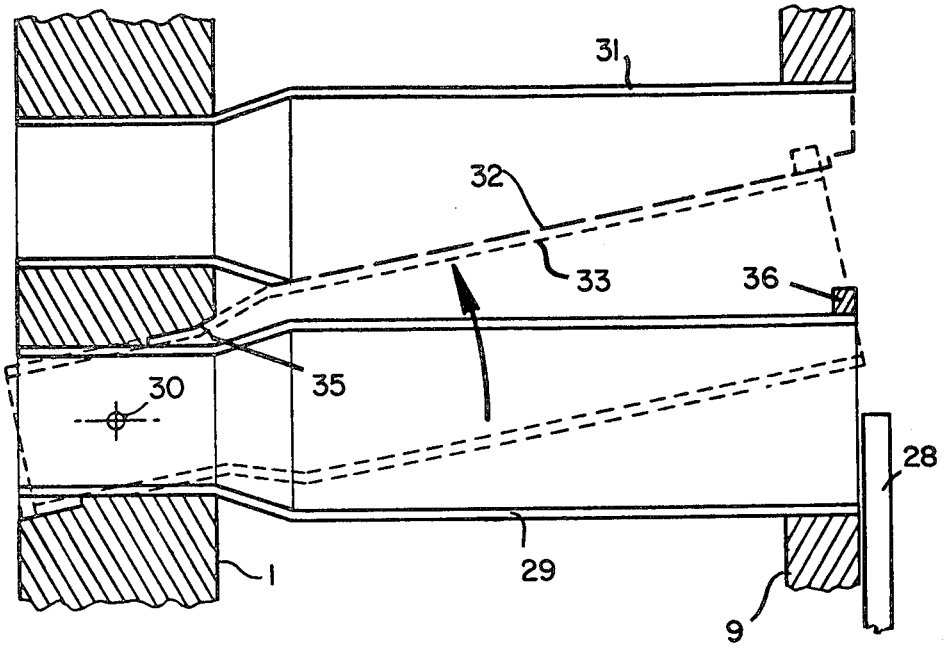
FIG. 3 is a side cross-sectional view of an alternative embodiment of the present invention.

The ammunition rack of the present invention provides means to hold a plurality of rounds of ammunition. The rack comprises, in general, a front warhead block-mount fixture and a base block-mount fixture, each having a plurality of sleeve holes, and tubular sleeves whose opposite ends are removably mounted in the aligned holes in the two respective block-mount fixtures. Each round of ammunition is removably held in a sleeve and the sleeves are held separated from each other without contact.

With reference to FIG. 1, the warhead block-mount fixture 1(front block mount) comprises a block of polymeric material having opposite front and back parallel faces and having a plurality of sleeve holes (bores) 2 therethrough aligned in columns and rows. L-shaped retention brackets 5*a*, 5*b* are secured to the block-mount fixture 1. Preferably a pair of retention brackets 5*a* are fastened on opposite faces along one side of the rectangularly shaped block-mount fixture 1 and a separate pair of retention brackets 5*b* are fastened on opposite faces along the bottom of the block-mount fixture 1. Although not shown, additional brackets are preferably used along the opposite side edge and top of the fixture 1. The brackets are used to secure the fixture 1 to the internal walls of the ammunition compartment.

The base block-mount fixture 9 is positioned parallel with the warhead block-mount fixture 1 and separated therefrom. The base block-mount fixture 9 is also of polymeric material and has a plurality of holes 10 arranged in rows and columns, with the center of the holes of the base block-mount fixture 9 aligned with the center of the corresponding holes in the warhead fixture 1. A suitable polymeric material for both block-mount fixtures 1 and 9 is a polymeric material which is a plastic resin and which is resilient, flexible and energy absorbing. A suitable polymeric material is ISODAMP, a registered trademark of ERA Corporation of Indianapolis, Ind., and the preferred polymeric material is "Isodamp" Product No. C-100299.

A plurality of sleeves, each of which is an elongated cylindrical tubular member, are mounted in the holes of, and extending between, the warhead block-mount fixture 1 and the base block-mount fixture 9. The sleeves are of metal, preferably aluminum. The front end of each sleeve, of reduced diameter, is held within a hole 2 in the warhead block-mount fixture 1. The rear end of each of the sleeves is held in a hole 10 in the base block-mount fixture 9. A round of ammunition 7 may be inserted and removably held within each of the sleeves 6.

The base block-mount fixture 9 is secured to the interior wall of the ammunition compartment by means of L-shaped retention brackets 13*a*, 13*b*. Preferably a retention bracket 13*a* is secured on the sidewall and a retention bracket 13*b* is secured to the bottom of the ammunition compartment. The retention brackets may be glued or otherwise adhered to the respective block-mount fixtures 1 and 9 or, alternatively and preferably, they are secured using a washer 14 and a bolt 15 which screws into the screw threads within the metal retention brackets 5*a*, 5*b*, 13*a* and 13*b*.

Each of the block-mount fixtures 1 and 9 has means to help locate the block-mount fixtures relative to the walls of the ammunition compartment and to aid in damping road shocks. In this embodiment the shock means consist of protuberances which are integral with the block-mount fixtures. A set of protuberances 4 are located on the side of the block-mount fixture 1 and a set of similar floor mounting protuberances 3 are located on the bottom of the warhead block-mount fixture 1. Similarly, a set of wall-mounted protuberances 12 are located along the side and integral with the base block member 9 and a set of floor-mounted protuberances 11 are located at equally spaced distances along the bottom edge of the base block-mount fixture 9. Since the protuberances are of polymer material they absorb and dampen road shocks.

FIG. 2 illustrates the setting position for two different types of ammunition rounds within the sleeves. As shown, the sleeve 6 is preferably removably secured within the warhead block-mount fixture 1 and the base block-mount fixture 9. One means of removably securing the sleeve 6 to the warhead block-mount fixture 1 includes a spring clip 22 which is fixed in a recess 24*a* in the sleeve 6 and is secured therein by a brad 23. The spring clip is of an inverted V-shaped spring metal band and by its spring action fits within the recess 24*b* in the block-mount fixture 1. The inverted V-shape of the spring clip 22 permits the sleeve to be withdrawn. Alternatively, and not shown, the sleeves may be fastened in the holes using gripping tabs or strips on the inner walls of the holes.

Both the warhead block-mount fixture 1 and the base block-mount fixture 9 have integral means to prevent shock to the round of ammunition during loading and to help secure the ammunition in position without vibration or movement during travel of the vehicle. A loading shock stop flange 18 is provided integrally with the warhead block-mount fixture 1. The flange 18 has an inner ledge portion 18*a* which fits against a descending portion of the HEAT warhead which is illustrated at the top portion of FIG. 2. The shock stop flange 18 has an inner throat portion 18*b* having a taper or slant which fits against the slanting face of an HE warhead, as shown in the bottom portion of FIG. 2. Consequently, the shock stop flange 18 is adapted to receive either type of warhead.

The base block-mount fixture 9 has a flexible protruding flap 19 which fits against the flange 19*a* of the ammunition round. The loading shock flap 19 is flexible so that it prevents undue shock to the ammunition round when it is loaded. The base block-mount fixture 9 has a latching mechanism to removably hold the ammunition round in position. The preferred base latch 20, shown in FIG. 2, comprises a pivotable hook member 27 having a pivot 25, pivotly mounted to the base, which is spring-loaded by the spring 26. The base latch 20 is finger-operated to be opened when the ammunition round is to be removed.

An alternative to the prior embodiment of the ammunition rack is illustrated in FIG. 3, which shows a swing-mounted ammunition sleeve. The embodiment of FIG. 3 may be particularly useful in a situation where there is an obstruction, such as the wall 28 of the ammunition compartment of the vehicle, which would prevent direct entry of an ammunition round into a sleeve. An ammunition round could not be loaded along the imaginary axis of the sleeve 29, in its resting position, since such loading would be obstructed by the wall 28. Consequently, the sleeve is made so that it swings about an axis 30 and the ammunition round may be loaded by clearing the end of the obstructing wall 28.

The neighboring sleeve 31 is partly cut along the diagonal line 32, removing a portion of its sleeve wall and base fixture 9, to make room for the outer swinging position of the sleeve 29 shown by dashed lines 33. In addition, some material is removed from the warhead block-mount fixture 1 to permit the swinging motion of the sleeve 29; but sufficient material is left at the corner 35 to provide resilience, i.e., a spring action which avoids undue shock on the sleeve 29 and helps restore it to its storage position. The storage position is the position shown in the full lines. A small block 36 of polymeric material is preferably attached to the outer end of the sleeve 29 which helps prevent undue shock on the sleeve when it is swung into its loading position, and also acts as a spacer to space the sleeve 29.

Figure 4:
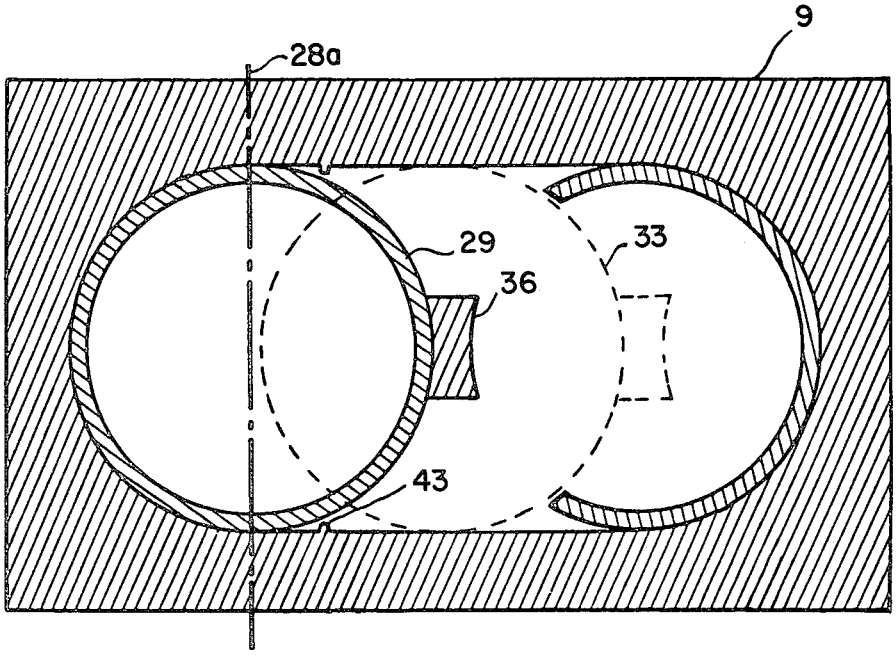
FIG. 4 is an end cross-sectional view of the embodiment shown in FIG. 3.

FIG. 4 shows an end plan view of the swingable sleeve 29. The sectional view shows the sleeve 29 in its storage position with its attached block of polymeric material 36. The dashed line 33 illustrates the position of the sleeve 29 after it has been swung outwardly to clear the obstruction (indicated by the dashed line 28*a*) and permit loading of the round. Preferably small bosses (latch nubs) 43 are integrally molded in the base block-mount fixture 9 and are used to retain the sleeve 29 in its storage position.

Figure 5:
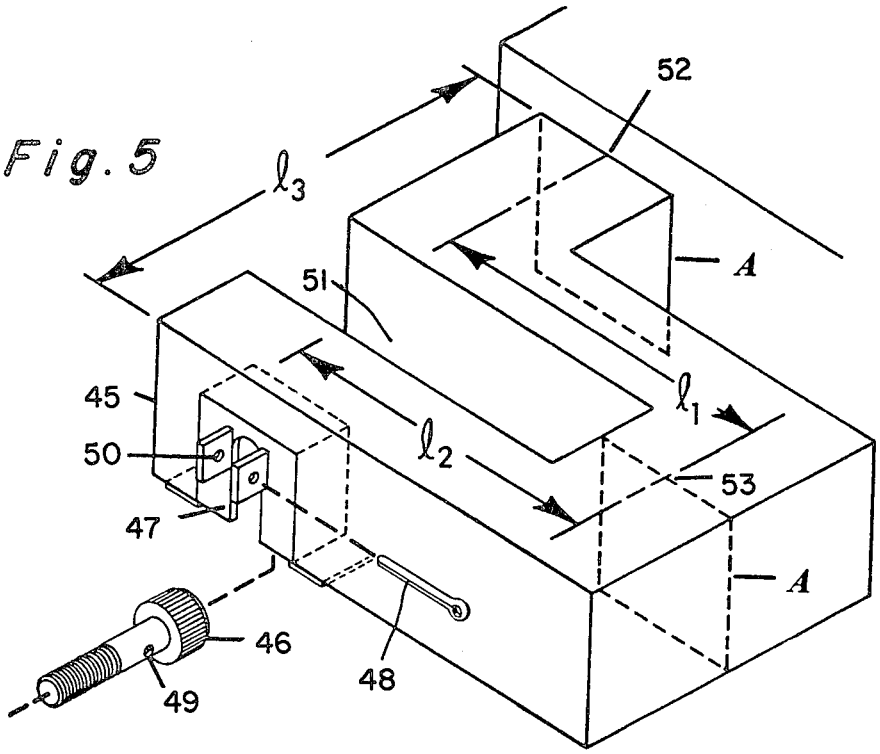
FIG. 5 is an enlarged perspective view illustrating an absorption mount which may be used in connection with the present invention.

An alternative embodiment of the wall road shock mount design is illustrated in FIG. 5. This is a torsion bar design in which the damping and resiliency is obtained by the resistance to a twisting movement. The torsion bar absorption mechanism illustrated in FIG. 5 is comparatively complex compared to the protuberances which provide shock protection in the embodiment of FIG. 1. However, it provides a superior shock absorbing and damping mechanism.

The torsion bar mechanism includes an integral extension 45 of either the warhead block-mount fixture 1 or the base block-mount fixture 9. An attachment bolt 46 fits within the metal receptacle fixture 47. The metal receptacle fixture 47 is located in a recess in the torsion bar extension 45 and may be secured therein by molding, welding or adhesives. The torsion bar extension 45 is secured in the wall of the ammunition compartment by means of the cotter pin 48 which is inserted through the holes 50 in the metal receptacle 47 and passing through the hole 49 in the bolt 46. The groove 51 in the torsion bar extension 45 increases the length of the moment arm (lengths $L_1$ and $L_2$) and reduces its spring constant (k). Although only two cuts are shown in the embodiment of FIG. 5, additional cuts may be made to increase the moment arm length. The moment arm length in this case is (1) $L=l_1+l_2$.

The labels $l_1$ and $l_2$ are shown in FIG. 5 at the top of the torsion bar extension. Actually, their centers of action lie at the centers of the respective uncut areas and at the center of the bolt 46 which serves as the axis. The cross-sectional areas of the torsion bar extension 45 at 52 and 53 are shown to have the value A (both are taken to be the same in cross-sectional area although the cross-sections may differ). For a material of torsional rigidity $\alpha$, cross section A and length $l_3$ (as shown in FIG. 5), the force F for an angular deflection $\theta$ is (2) $F—\alpha A\theta/l_3$.

For a supported mass M, the equation for the motion of the system under impulsive loading, such as by road shock, is (3) $M\,d^2\theta/dt^2=-k\alpha$, where t is the time and (4) $k=\alpha A/l_3$. For such a motion the angular frequency of vibration $\omega_o$ is (5) $\omega_o=\sqrt{k/M}$.

When, as in the present case, an energy absorbing material is used, the equation of motion (3) is replaced by the equation for damped harmonic motion (6) $Md^2\theta/dt^2+fd\theta/dt+k\theta=o$ where the energy absorption term's coefficient F is given in terms of an energy absorbing characteristic e of the material by (7) $f=eA/l_3$.

The solution to Equation (6) is (8) $\theta=\theta_o\exp(-\lambda t)\exp(i\omega_1 t)$ where (9) $\omega_1=(\omega^2{}_o-\lambda^2)^{\frac{1}{2}}$, $\omega_1$ being the altered frequency of the system. The system is critically damped when (10)$\lambda=\omega_o$. Thus, when the requirement to dampen road shock motion is at a frequency $\nu$, the element of FIG. 5 is to have dimensions yielding $\nu=\omega_1/2\pi$ and with the condition of Equation (1) satisfied. Although $\nu$ as given by Equation (11) is the frequency of critical damping of the system, damping occurs at other frequencies as well, as specified by Equation (8). One can modify the design to provide a broad damped frequency band by incorporating several road shock mount elements of the type shown. Each may be critically damped at a different frequency, so that the total damping overlaps for a broad frequency band.

Figure 6:
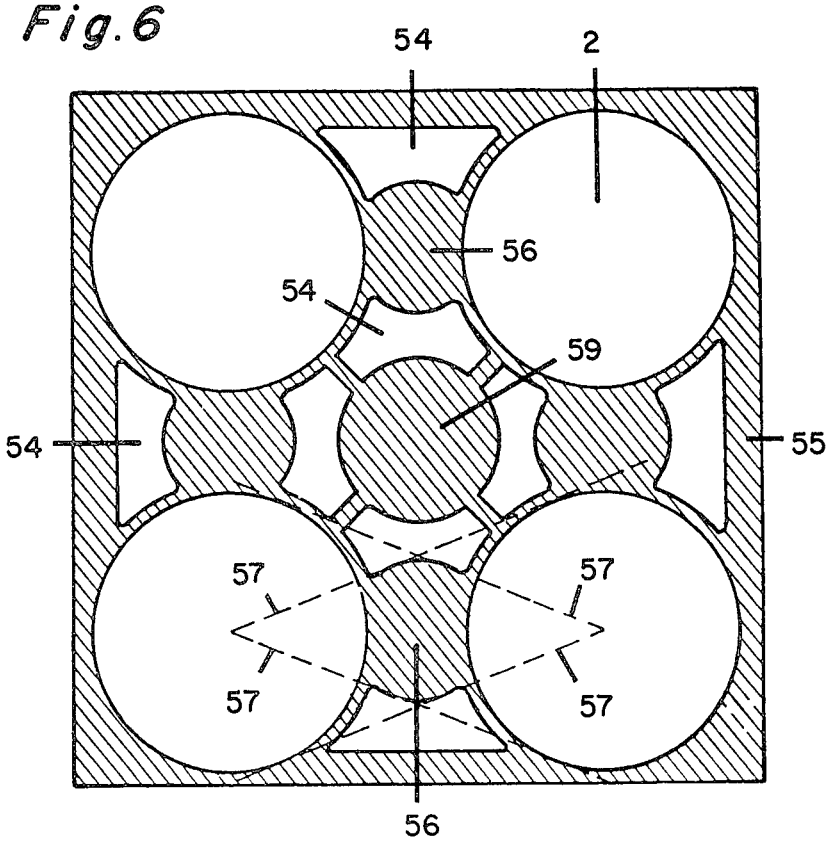
FIG. 6 is an end view of an alternative embodiment of a portion of the ammunition rack of the present invention.

In the embodiment of FIG. 6, either the warhead block-mount fixture 1 or the base block-mount fixture 9, or both, are provided with openings. Such openings decrease the weight of the fixtures, are a cost reduction measure since less polymeric material is used, and improves gas benting, since there are greater openings through which the gas may escape. The gas hole vent holes 54 are cut or molded so that they are through the entire thickness of the block-mount fixture. However, the material 56 which is directly between the axes of the centers of the sleeves is left in place to provide support to the sleeves and their enclosed ammunition rounds. Similarly, the material which is directly on the diagonal from one axis to another is left in place and forms a central area of material 59.

In another alternative, although not shown, additional anti-fratricide material such as metal plates may be molded in place or attached to the block-mount fixtures in order to improve the anti-fratricide ability of the ammunition rack. In such case it may be necessary to employ polymers of different densities in the fabrication of the block-mount fixtures.

What is claimed is:

1. In an improved ammunition supportive rack for a tank adapted to hold a plurality of fragile 120 MM combustible shells in an explosive environment in order to protect said shells from fratricide and road shock, the improvement consisting essentially of:

a plurality of 120 MM combustible shells having a warhead and a base with a fragile explosive body therebetween, a warhead block-mount fixture molded of resilient polymeric material having a plurality of supportive holes therethrough, said warhead fixture having molded integrally therewith a plurality of flanges inwardly directed into each of said holes and adapted to separably engage said warhead of said shell as a shock-mount, a base block-mount fixture positioned in spaced relation parallel to said warhead fixture, said base-fixture molded of resilient polymeric material and having a plurality of holes therethrough, each of said holes in said base fixture axially aligned with a hole in said warhead fixture, said base-fixture provided with a plurality of pivotal latches adjacent each of said holes to separably engage said base of said shell to secure the same in a supportive position a plurality of metal tubular sleeves member having two ends and a body, one of said ends removably positioned in a hole in said warhead fixture and the other of said ends removably positioned in said base fixture with said body extending therebetween, each of said sleeves adapted to removably support said combustible shells, each of said sleeve member removably secured in said fixtures by a spring clip provided on said sleeve and engaging said warhead fixture.

2. The ammunition rack of claim 1 having a series of protuberances integrally molded on one side and the bottom of said fixtures for abutting engagement with flat areas in said tank.

3. The ammunition rack of claim 2 wherein at least one of said sleeves is pivotally mounted on said warhead fixture for travel between a loading position and a stored position.

4. The ammunition rack of claim 2 wherein said base-fixture is provided with a flexible member for engagement with said base of said shell for resilience.

5. The ammunition rack of claim 4 having a torsional suspension mounting affixed to each of said fixtures and the side of said tank.

* * * * *